United States Patent [19]

Ishihara

[11] 4,173,951

[45] Nov. 13, 1979

[54] POWER PLANT FOR SIMULTANEOUSLY GENERATING ELECTRIC POWER AND PNEUMATIC PRESSURE

[76] Inventor: Masamitsu Ishihara, 628 Hirai, Kannami-cho, Tagata-gun, Shizuoka-ken, Japan

[21] Appl. No.: 846,453

[22] Filed: Oct. 28, 1977

[30] Foreign Application Priority Data

Jun. 9, 1977 [JP] Japan ..... 52-75375

[51] Int. Cl.[2] ..... F02B 63/04; F02B 63/06

[52] U.S. Cl. ..... 123/2; 123/198 E; 290/1 A; 290/1 B; 417/364

[58] Field of Search ..... 123/2, 198 E; 290/1 R, 290/1 A, 1 B; 417/364

[56] References Cited

U.S. PATENT DOCUMENTS

| | | | |
|---|---|---|---|
| 1,522,612 | 1/1925 | Burchett | 290/1 A |
| 1,573,883 | 2/1926 | Vining | 290/1 B |
| 1,608,528 | 11/1926 | Raymond | 417/364 |
| 2,086,036 | 7/1937 | Juergens | 123/198 E |
| 2,103,861 | 12/1937 | Melcher | 417/364 |
| 2,364,013 | 11/1944 | Waseige | 290/1 A |
| 3,046,899 | 7/1962 | Biefang | 290/1 R |
| 3,497,133 | 2/1970 | Childress et al. | 417/364 |
| 3,586,238 | 6/1971 | Schmierer et al. | 123/2 |
| 3,610,216 | 10/1971 | Braun | 417/364 |

*Primary Examiner*—Charles J. Myhre
*Assistant Examiner*—Craig R. Feinberg

[57] ABSTRACT

A power plant for simultaneously generating electric power and pneumatic pressure which comprises an engine, dynamo and compressor all juxtaposed, and wherein the crankshaft of the engine is disposed on the axis of a common shaft to the dynamo and compressor to be drivingly coupled to the common shaft and jointly rotated with the common shaft, thereby simultaneously generating electric power and pneumatic pressure.

1 Claim, 1 Drawing Figure

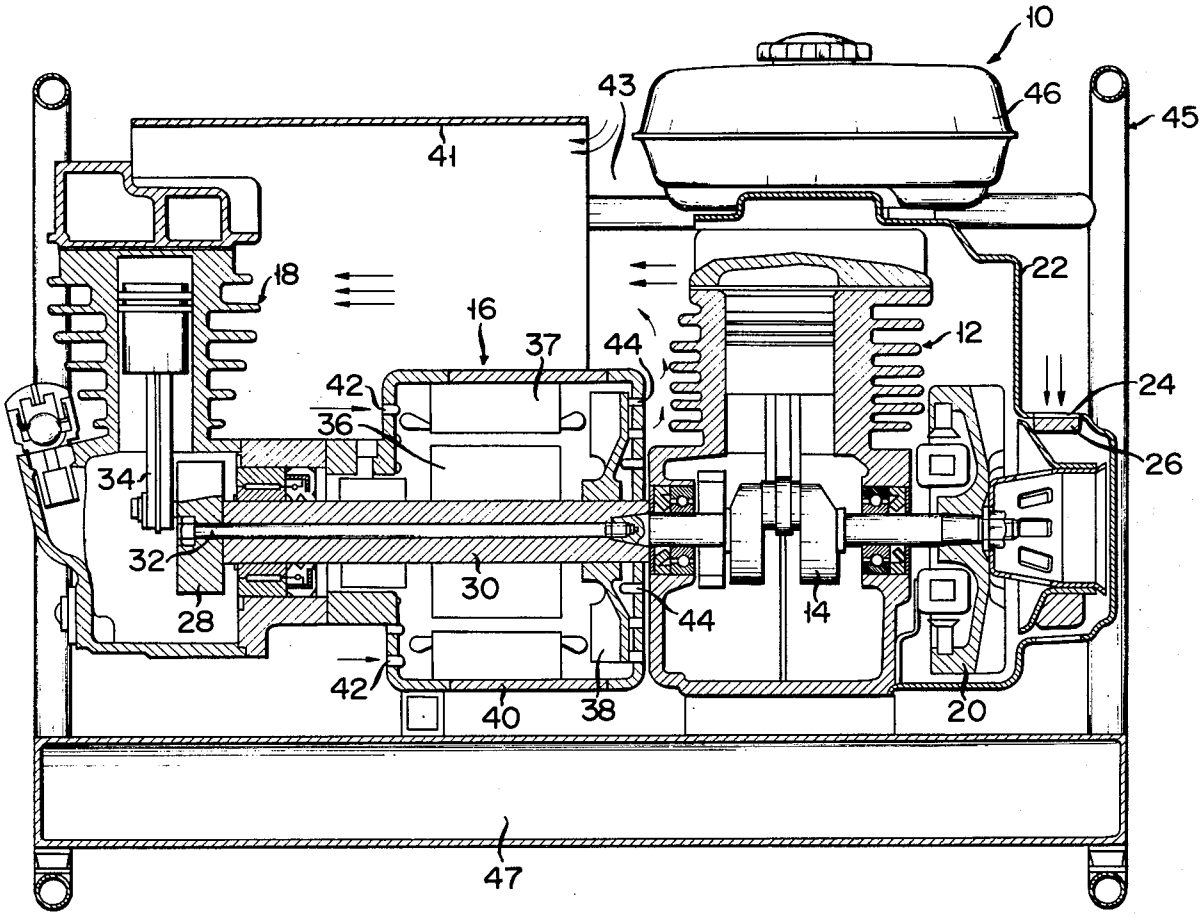
10
12
14
16
18
20
22
24
26
28
30
32
34
36
37
38
40
41
42
43
44
45
46
47

POWER PLANT FOR SIMULTANEOUSLY GENERATING ELECTRIC POWER AND PNEUMATIC PRESSURE

BACKGROUND OF THE INVENTION

This invention relates to a dynamo and/or compressor, and more particularly to a power plant designed for simultaneous generation of electric power and pneumatic pressure.

Various types of dynamo and compressor have hitherto been applied independently in many industrial fields. In recent years, however, operations requiring the simultaneous application of a dynamo and compressor have increased in number. For example, repair of punctures is effected by application of not only a compressor but also a dynamo for lighting. Painting work needs a compressor to supply compressed air to a spray and also a dynamo for lighting. Further, a construction site has to be provided with a compressor for a pneumatic riveter and also a dynamo to drive, for example, a power saw and power planer. In the future, works relying on the simultaneous drive of a dynamo and compressor to apply electric power and pneumatic pressure at the same time are expected to increase in number. At present, however, the known types of dynamo and compressor are constructed as independent units. Such situation gives rise to the drawbacks that a great deal of time and work is consumed in installing a dynamo and compressor at the prescribed sites; maintenance of the separate engines of both units is a considerably time-consuming work, thus failing fully to meet industrial requirements. Further disadvantages are that any known dynamo and compressor are constructed in a relatively large size and generally set in different places, making it necessary to provide a considerably space for their installation.

SUMMARY OF THE INVENTION

It is accordingly an object of this invention to provide a power plant, wherein a dynamo and compressor are constracted in a compact integral body to be driven by a single engine, thereby simultaneously generating electric power and pneumatic pressure by driving the dynamo and compressor at the same time. It is another object of the invention to provide a power plant admitting of its own effective cooling by controlling forcefully ejected air streams, while simultaneously producing electric power and pneumatic pressure.

BRIEF DESCRIPTION OF THE DRAWING

The appended drawing is a longitudinal sectional view of a power plant according to a preferred embodiment of this invention.

DETAILED DESCRIPTION OF THE PREFERRED EMBODIMENT

With a power plant 10 embodying this invention, a dynamo 16 and compressor 18 are fitted, as shown in the drawing, in parallel to the crankshaft 14 of a common engine 12. A fan 20 is disposed on the outer side, namely, at the right end of the crankshaft 14 of the common engine 12. A cover 22 is built about the common engine 12 fully to enclose the fan 20 and said engine 12. The fan 20 forcefully cools the common engine 12 by sucking air through a punched iron net plate 26 at an opening 24 bored in the cover 22.

An eccentric disk 28 and shaft 30 are fixed to the crankshaft 14 by a bolt 32. The eccentric disk 28 is fitted with the piston rod 34 of the compressor 18, and the shaft 30 is fitted with the rotor 36 of the dynamo 16. A stator 37 is disposed to face the rotor 36. A fan 38 is fitted to the shaft 30 on that side of the dynamo 16 which lies adjacent to the common engine 12 received in a housing 40. The fan 38 sucks air at an inlet port 42 bored in the left wall of the housing 40 and discharges air at an outlet port 44 bored in the right side wall of the housing 40. The outlet port 44 may take an annular form. The fan 38 generates air streams for cooling not only the dynamo 16 itself, but also the common engine 12. Open air streams sucked by the fan 20 of the common engine 12 converge with air streams blown toward the common engine 12 by the fan 38. The converged air streams again run toward the compressor 18 for its cooling. Cool open air is also brought in at an opening 43 bored in the right side wall of a cover 41 enclosing the dynamo 16 and compressor 18 and converges with air streams forcefully sent forth from the common engine 12.

The converged air streams are also carried toward the compressor 18 for its cooling. The covers 22, 41 may be formed in an integral body.

The common engine 12, dynamo 16 and compressor 18 are compactly received in a pipe frame 45. A gasoline tank 46 for the common engine 12 is mounted on the pipe frame 45. An air tank 47 for the compressor 16 is positioned below the pipe frame 45. A power output panel (not shown) fitted with sockets and instruments is set up at a readily visible spot. To effect the easy transport of the subject power plant 10, it is advised to apply various practical devices, for example, to fit a foldable caster to the lower part of the pipe frame 45.

According to this invention, the common engine 12, dynamo 16 and compressor 18 are juxtaposed. Electric power and pneumatic pressure are simultaneously generated by the rotation of the crankshaft 14 of the common engine 12, thereby fully meeting the requirements of various works which use electric power and pneumatic pressure at the same time. The common engine 12, dynamo 16 and compressor 18 constituting the subject power plant 10 are juxtaposed in a single frame, thereby enabling the power plant 10 to be easily installed and operated. Provision of a single engine prevents its maintenance from consuming a great deal of time, through said maintenance as essentially a troublesome work. Further, the common engine 12, dynamo 16 and compressor 18 which are compactly received in the frame 45 only demands a small space of installation.

In the case of this invention, it is preferred to set the dynamo 16 at the center of the subject power plant 10, thereby causing air streams forcefully ejected from the fan 38 of the dynamo 16 to be conducted to the common engine 12 for its cooling. Further, the fans 20, 38 and covers 22, 24 should be so arranged as to cause cool open air to be sucked and carried toward the compressor 18 in covergence with air streams forcefully ejected from the fans 20, 38 of the common engine 12 and dynamo 16 respectively. The cooling system included in the power plant of this invention which generates the above-mentioned air streams can effectively cool the power plant.

What is claimed is:

1. A power plant for simultaneously generating electric power and pneumatic pressure, comprising: an engine having a crankshaft and a fan disposed on said crankshaft outside said engine, a dynamo for generating electric power and having a shaft drivingly coupled to the crankshaft of said engine, a compressor for generating pneumatic pressure and having a piston rod having one end thereof eccentrically drivingly connected to said crankshaft of said dynamo for rotation therewith, said engine, dynamo and compressor being arranged parallel to and substantially in alignment with each other, and a cover enclosing said dynamo and compressor and provided with an opening positioned above said dynamo, said dynamo being juxtaposed between said engine and said compressor and having a fan disposed on that side of the dynamo which lies adjacent said engine, and means for cooling said compressor comprising air streams produced by said fan of said engine coverging with air streams produced by said fan of said dynamo and air streams sucked in through said opening of said cover being carried toward said compressor.

* * * * *